US006257779B1

(12) United States Patent
Harris et al.

(10) Patent No.: US 6,257,779 B1
(45) Date of Patent: Jul. 10, 2001

(54) COVER-PLATEN OPENING MECHANISM

(75) Inventors: Richard Hunter Harris, Raleigh; Robert Andrew Myers, Cary; Jeff David Thomas, Raleigh, all of NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/580,415

(22) Filed: May 30, 2000

Related U.S. Application Data

(62) Division of application No. 09/478,684, filed on Jan. 6, 2000, which is a division of application No. 09/041,172, filed on Mar. 12, 1998, now Pat. No. 6,102,590.

(51) Int. Cl.[7] ..... B41J 11/20
(52) U.S. Cl. ..... 400/55; 400/613
(58) Field of Search ..... 400/55, 56, 613, 400/613.1

(56) References Cited

U.S. PATENT DOCUMENTS 5,752,779 * 5/1998 Passer et al. ..... 400/613.3
5,791,796 * 8/1998 Gustavsson et al. ..... 400/613
6,017,159 * 1/2000 Tse ..... 400/613

* cited by examiner

*Primary Examiner*—Eugene Eickholt
(74) *Attorney, Agent, or Firm*—John D Flynn; Winstead, Sechrest & Minick, LLP

(57) ABSTRACT

An apparatus for opening a platen in an impact printer is implemented. The apparatus permits rapid loading of a paper supply while maintaining the required tolerance in the spacing of the platen and a printhead. The mechanism also accommodates the printing of form documents in which the thickness of the document material may be variable. The mechanism adjusts to the varying thickness of the document medium while maintaining the required tolerance in the spacing between the platen and printhead.

3 Claims, 8 Drawing Sheets

COVER-PLATEN OPENING MECHANISM

CROSS REFERENCE TO RELATED APPLICATION

This application is a divisional of U.S. application Ser. No. 09/478,684 filed on Jan. 6, 2000, which in turn is a divisional of application Ser. No. 09/041,172 filed on Mar. 12, 1998, now U.S. Pat. No. 6,102,590.

TECHNICAL FIELD

The present invention relates in general to impact printers, and in particular, to a cover-platen opening mechanism in such printers.

BACKGROUND INFORMATION

Printers used in point-of-sale applications frequently need to have a paper supply reloaded by an operator who may be new to the job, or otherwise untrained. Moreover, it is often necessary that the paper be reloaded while customers are waiting to be served. Impact printers require close tolerances between the printhead and the platen. As a consequence, impact printers according to the prior art require the threading of paper through the printing mechanism, and a simultaneous manipulation of feed actuating mechanisms to load the paper in order that the relationship of the printhead and paper maintain the required tolerance. Moreover, the implementation of alternate paper feed paths in order to provide for the printing of form documents, as well as printing onto paper supplied in bulk, is difficult to implement in point-of-sale impact printers according to the prior art. The close tolerances between the printhead and the platen must be maintained in the presence of forms having different thickness paper. This is precluded in the impact printing mechanisms in printers having a platen and printhead with a fixed relative position, according to the prior art Thus, there is a need in the art for a mechanism that allows simple drop-and-load paper loading while maintaining tight head gap tolerances, and in which form thickness compensation is accommodated.

SUMMARY OF THE INVENTION

The present invention addresses the previously mentioned needs by providing a cover-platen opening mechanism that permits drop-in replacement of a paper supply roll without the necessity of threading the paper through the platen and printhead mechanism. At the same time, the cover-platen opening mechanism according to the principles of the present invention maintains the required platen-printhead spacing tolerances.

In a cover-platen opening mechanism according to the principles of the present invention, a platen shaft longitudinally affixed to the platen forms a pivotal attachment to a cover frame. A protrusion on a first end portion of the platen provides a bearing surface for engaging a spring. The platen has a stop attached to a pre-determined one of a first and a second end portion. The stop engages positioning means that displaces in response to the thickness of a form document onto which printing is to be performed. The spacing between the platen and a printhead is thereby adjusted in response to the thickness of the form document.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
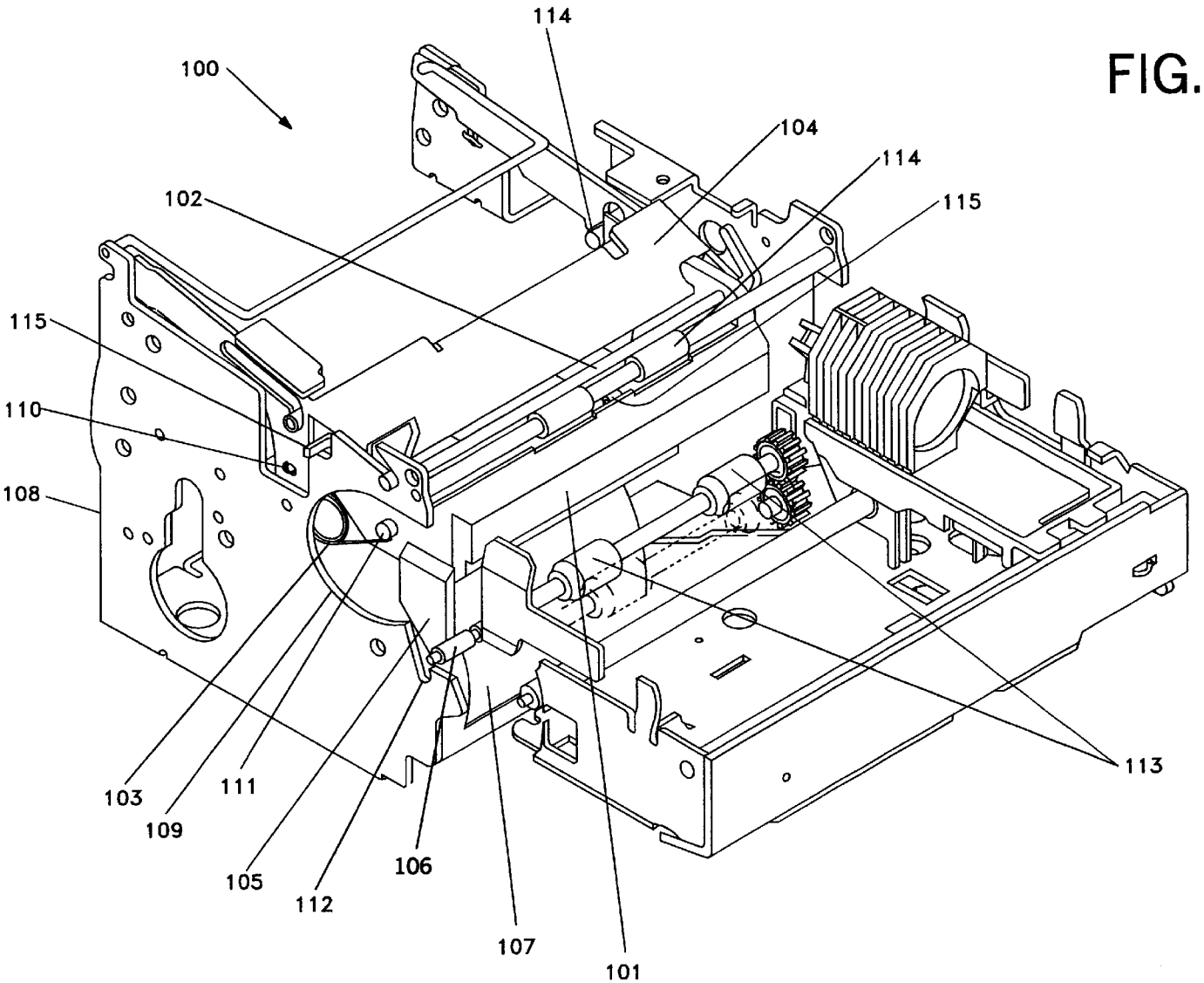
FIG. 1 illustrates, in perspective view, a cover-platen opening mechanism in accordance with an embodiment of the present invention.

In the following description, numerous specific details are set forth to provide a thorough understanding of the present invention. However, it will be obvious to those skilled in the art that the present invention may be practiced without such specific details. Refer now to the drawings wherein depicted elements are not necessarily shown to scale and wherein like or similar elements are designated by the same reference numeral through the several views.

Refer now to FIG. 1 in which is depicted in perspective view cover-platen opening mechanism 100 in accordance with an embodiment of the present invention. Cover-platen opening mechanism 100 includes platen 101, platen shaft 102, torsion spring 103, cover frame 104, primary stop 105, and document feed roller Tee bushing 106.

Platen 101 is pivotally attached to platen shaft 102 which is supported in V-notch 107 in a first side of frame 108, as illustrated in FIG. 1. The second end of platen shaft 102 is similarly supported in a second V-notch in an opposite side of frame 108. Platen shaft 102 together with V-notch 107 provide a first point of suspension for platen 101.

A second point of suspension is provided by torsion spring 103. In FIG. 1, torsion spring 103 is viewed through cut-away 109 which is not a part of frame 108. A first end of torsion spring 103 bears on protrusion 111 on an end of platen 101. A second end of torsion spring 103, torsion spring end 110 is attached to cover frame 104 via a hole in a side portion thereof. This will be more clearly illustrated in FIG. 2, subsequently to be discussed.

Figure 6:
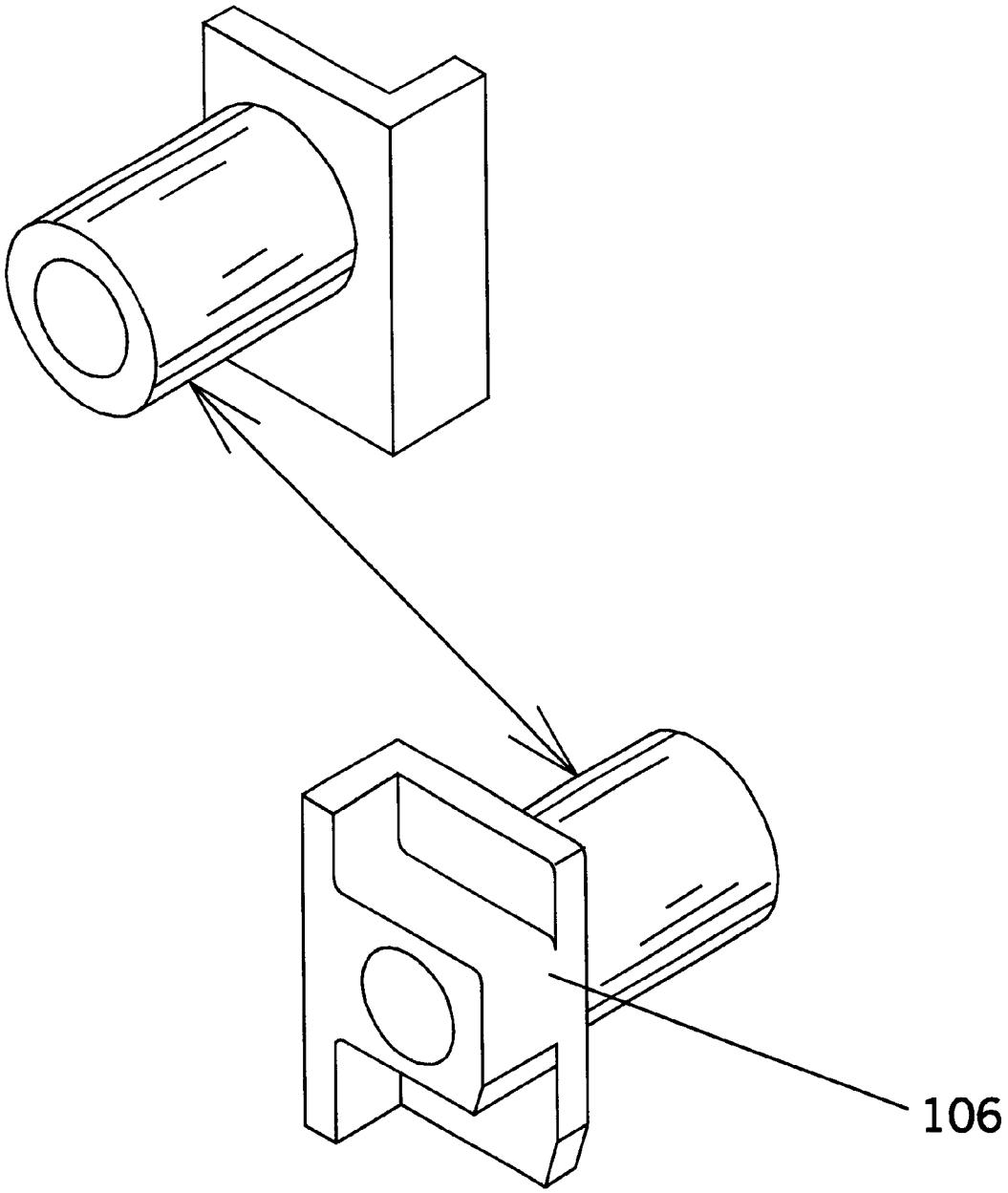
FIG. 6 illustrates a normal and rotated view of the Tee bushing accordance to an embodiment of the present invention.

A third point of suspension for platen 101 is provided by primary stop 105 which is fixedly attached to an end of platen 101. Primary stop 105 provides a third point of suspension in conjunction with document feed roller Tee bushing 106. Document feed roller Tee bushing 106 is supported in T-notch 112 in the side of frame 108. This will be more clearly illustrated in FIG. 2, to be discussed. Primary stop 105 bears against a cylindrical portion of Tee bushing 106 thereby forming the third point of suspension of platen 101. An end of document feed roller 113 is rotatably inserted into document feed roller Tee bushing 106. A second document feed bushing, not illustrated in FIG. 1, is fixed in the opposite side of frame 108, and likewise provides rotatable and pivotal support for a second end of document feed roller 113. Moreover, Tee bushing 106, and T-notch 112 into which it is inserted, together form a slidable support for document feed roller 113 on one side of frame 108. A detailed illustration, in normal and rotated views, of Tee bushing 106 is shown in insert "A" in FIG. 6.

Figure 2:
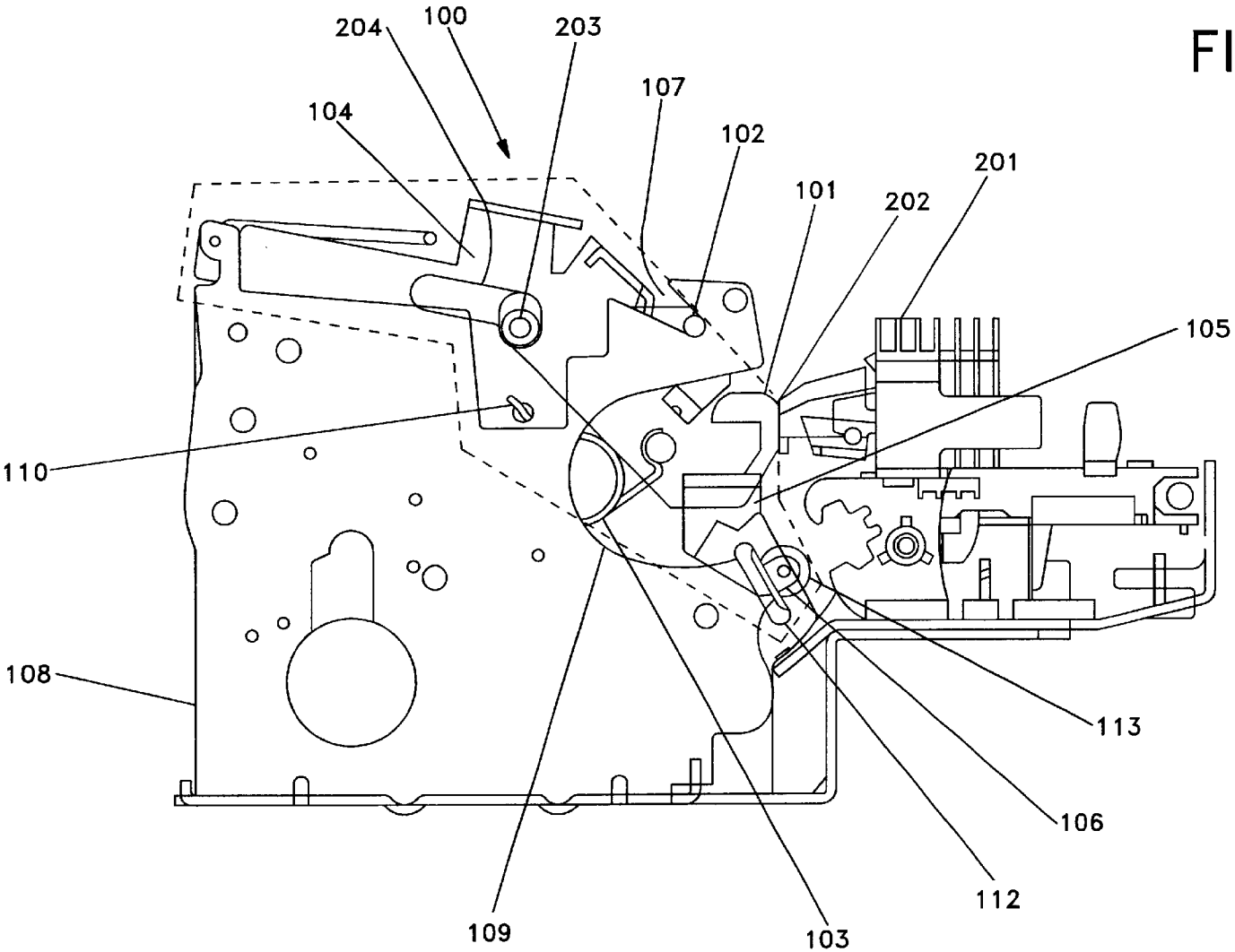
FIG. 2 illustrates, in side view, a cover-platen opening mechanism in accordance with an embodiment of the present invention.

Refer now to FIG. 2 showing an illustration of cover-platen opening mechanism 100 in a side elevation view. FIG. 2 clearly shows Tee bushing 106 slidably supported in T-notch 112 within frame 108. In FIG. 2, platen 101 and cover frame 104 are shown in the closed position. In the closed position, platen 101 is proximal to printhead 201, and separated therefrom by paper gap 202. The medium on which printing is to take place passes through paper gap 202 wherein printing is effected by printhead 201. Neither the printing medium nor inked ribbon are shown in FIG. 2 for clarity. It is necessary that the width of paper gap 202 be held within close, pre-determined tolerances while accommodating print media of varying thickness.

Varying thicknesses of print media are accommodated by the action of Tee bushing 106 and primary stop 105. This has been previously described in conjunction with FIG. 1, and may be clearly seen in FIG. 2. Recall that Tee bushing 106 provides a rotatable support for document feed roller 113. Tee bushing 106 is free to move in the a-b direction within T-notch 112. The maximum distance that Tee bushing 106 can move is determined by a width of T-notch 112- Document feed roller 113 forms one of a pair of pinch rollers that control the motion of a form document on which printing is to occur. The second roller has not been illustrated in FIG. 2 for clarity, but will be subsequently if described in conjunction with FIG. 3.

The displacement of Tee bushing 106 within T-notch 112 causes a slight rotation of platen 101 in the "c" direction (shown by the arrow) about platen shaft 102. This is accomplished through the action of primary stop 105 which bears on a cylindrical surface (not shown in FIG. 2) of Tee bushing 106, as has been previously described in conjunction with FIG. 1. Concomitant with the rotation of platen 101 about platen shaft 102 is a slight upward displacement of platen pivot 203 within J-notch 204 in cover frame 104. Thicker form documents cause Tee bushing 106 to displace further into T-notch 112 thereby producing a rotation, in the "c" direction, of platen 101 about patent shaft 102. As a consequence of the rotation, the width of paper gap 202 increases. Conversely, for thinner form documents, Tee bushing 106 displaces a shorter distance into T-notch 112, reducing the width of paper gap 202 when platen 101 rotates back in the "d" direction (shown by arrow) about platen shaft 102. In an embodiment of the present invention, document thickness is a range of from at least 0.004 inches to 0.019 inches may be accommodated. The present invention will work with other ranges of document thicknesses.

The rotation of platen 101 about platen shaft 102 is resisted by torques produced by platen torsion spring 103. These torques also tend to hold cover frame 104 in the closed position when cover-platen opening mechanism 100 is closed. The action of the torques acting on cover-platen opening mechanism 100 will now be discussed.

Figure 3:
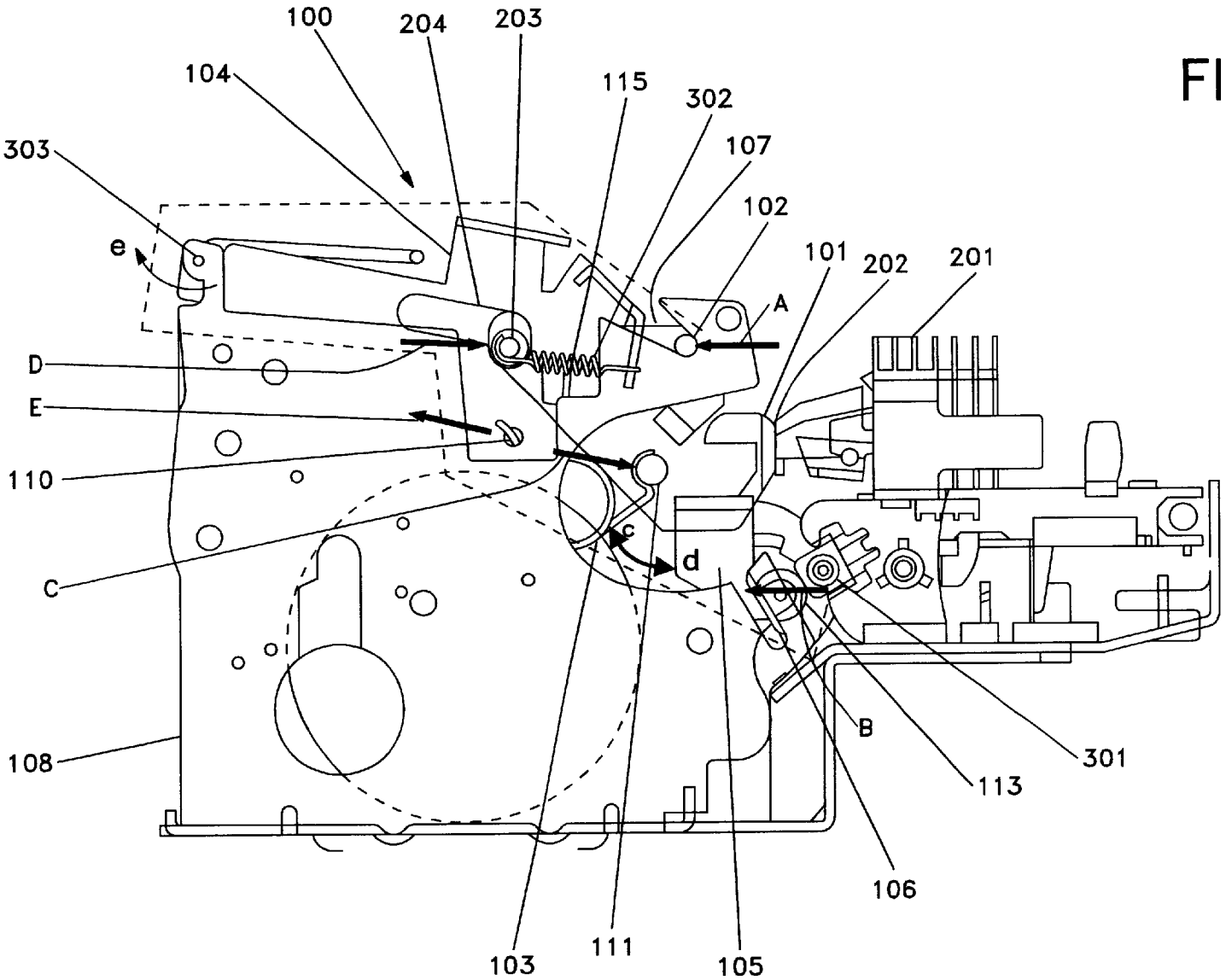
FIG. 3 illustrates, in side view, a cover-platen opening mechanism in accordance with an embodiment of the present invention.

Refer now to FIG. 3 also depicting cover-platen opening mechanism 100 in a side view in which the torque producing forces acting on cover-platen opening mechanism 100 are also illustrated. The significant reaction forces acting on platen 101 are denoted "A", "B", "C", and "D". Compressive forces in platen torsion spring 103 produce reaction force "C" acting on a line between the point of contact of the end of torsion spring 103 on protrusion 111, and platen torsion spring end 110 retained in cover frame 104. Because of the displacement between the point of contact of platen torsion spring 103 on protrusion 111 and platen shaft 102, reaction force "C" produces a torque about platen shaft 102 in the "d" direction as indicated by the arrow in FIG. 3. This torque is countered by a torque produced by reaction force "B" produced by document pressure roller 301 acting on document feed roller 113. A paper path for the feeding of form documents is formed between document pressure roller 301 and document feed roller 113 (as shown in FIG. 4B). The displacement of reaction force "B" from platen shaft 102 produces a torque about platen shaft 102 that is in the "c" direction, as indicated by the arrow, in FIG. 3. Reaction force "D" is a principally horizontal force produced by the tension in platen extension spring 302. One end of platen extension spring 302 is attached to cover frame 104, and a second end of platen extension spring 302 is attached to extension spring attachment 114 (obscured in FIG. 3), as illustrated in FIG. 1. Reaction force "D" acts on a line passing through a center line of platen shaft 102. Therefore reaction force "D" produces no torque about platen shaft 102. Reaction forces "C" and "D" are balanced by reaction force "B" and reaction force "A", which is produced by V-notch 107 acting on platen shaft 102. Reaction force "A" is also directed through an axis of platen shaft 102, thereby producing no torque about platen shaft 102. The balancing of the reaction forces acting on platen 101, and the torques they produce, maintain the relationship between platen 101, and printhead 201, and maintain the width of paper gap 202 within its pre-determined tolerance.

When cover-platen opening mechanism 100 is in the closed position, cover frame 104 is held closed by torque from platen torsion spring 103. Compressive force in platen torsion spring 103 produces a reaction on cover frame 104 at the point of attachment of platen torsion spring end 110 in cover frame 104. This force is shown as "E" in FIG. 3. Because the point of attachment of platen tension spring end 110 in cover frame 104 is displaced from cover pivot 303, it produces a torque about an axis through cover pivot 303. This torque is indicated by the direction of the arrow, "e", in FIG. 3, and tends to keep cover frame 104 in the closed position. The torque is countered by down stop 115 on cover frame 104, resting on frame 108.

Figure 4A:
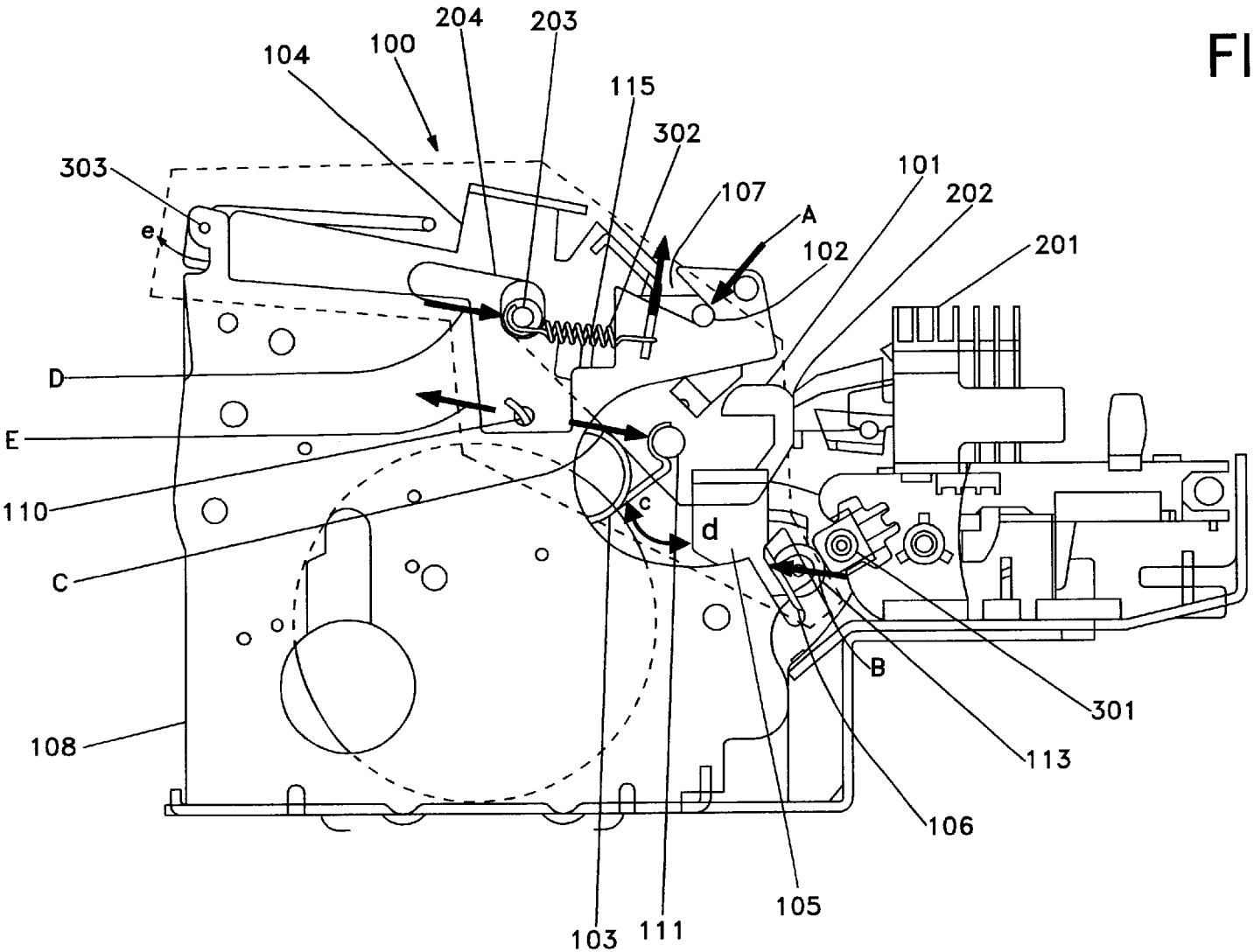
FIG. 4A illustrates, in side view, in closed position, a cover-platen opening mechanism in accordance with an embodiment of the present invention.
Figure 4B:
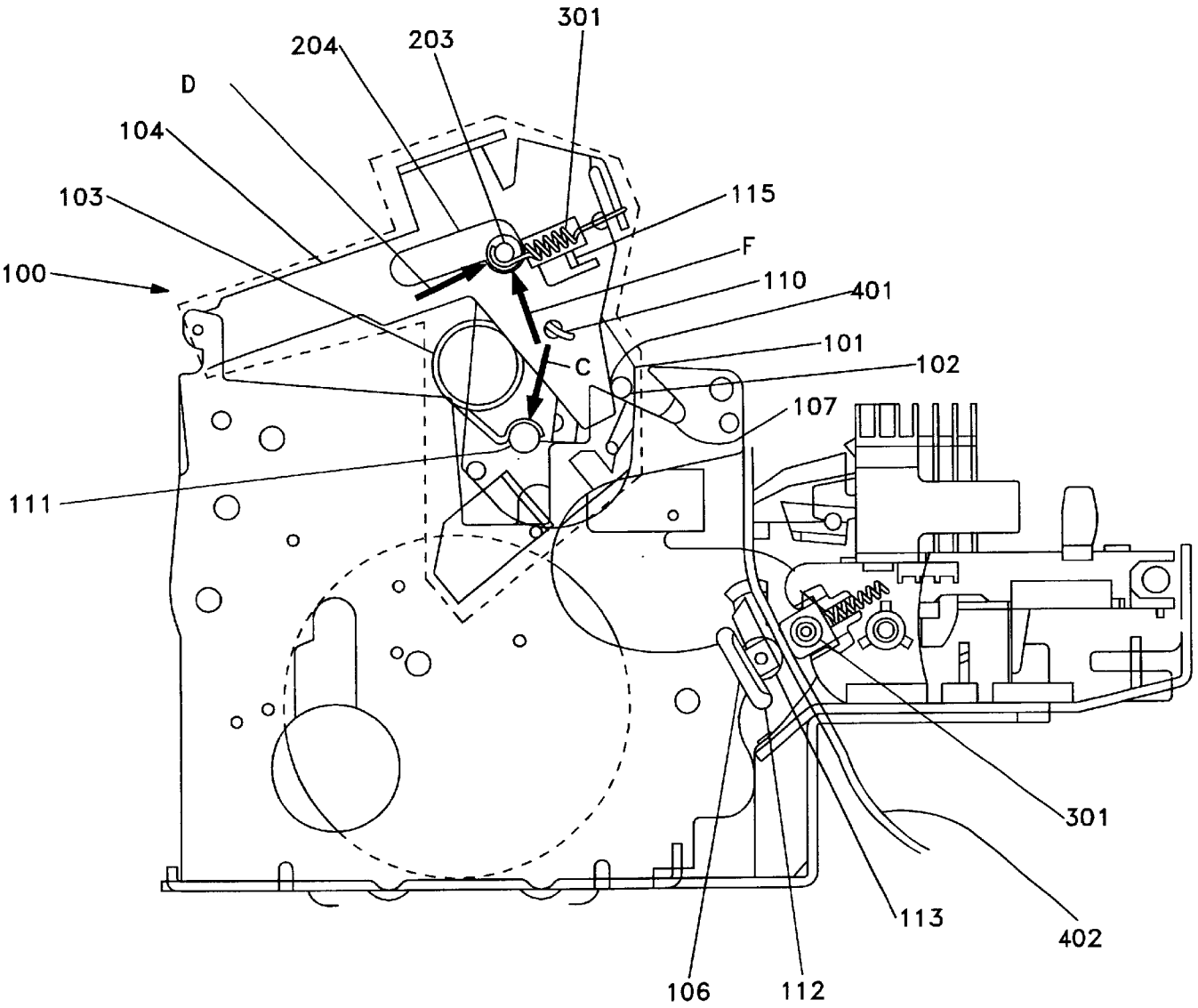
FIG. 4B illustrates, in side view, in partially open position, a cover-platen opening mechanism in accordance with an embodiment of the present invention.

Refer now to FIG. 4A, in which cover-platen opening mechanism 100 is illustrated in the closed position, at an instant before it opens in response to application of an opening force. Cover-platen opening mechanism 100 opens in response to the opening force applied at an end of cover frame 104. The opening force is supplied by an operator.

As cover frame 104 is displaced upward, it produces reaction force "F" (FIG. 4B) on platen pivot 203, resting in J-notch 204. Reaction force "A" on platen shaft 102 now includes a vertical component from an upper portion of V-notch 107, that balances reaction force "F".

While platen shaft 102 is so vertically constrained by V-notch 107, reaction force "A" produces a torque about an axis through pivot 203 causing platen 101 to rotate in the direction "c", indicated on FIG. 4A. As the platen is displaced vertically, platen shaft 102 begins to withdraw from V-notch 107, and continues to rotate about platen pivot 203 under the action of torque produced by reaction force "A".

The rotation of platen 101 in the direction "c" also causes a rotation of the line of force of reaction force "C", which lies along the line between the point of contact of the end of torsion spring 103 and protrusion 111, and the point of attachment of torsion spring end 110 in cover frame 104.

The rotation of the line of force of reaction force "C" causes the torque about the axis through platen pivot 203 to change direction when the line of force of reaction force "C" passes through that axis. After passage of the line of force of reaction force "C" through the axis through platen pivot 203, the torque produced by reaction force "C" now causes platen 101 to continue to rotate in the direction "c" about the axis through platen pivot 203. This occurs prior to platen shaft 102 being withdrawn from V-notch 107. Reaction force "A" is eliminated as a consequence. The rotation of platen 101 continues until platen shaft 102 is engaged by secondary platen stop 401 formed by a lower portion of cover frame 104. This is the condition of cover-platen opening mechanism 100 illustrated in FIG. 4B.

Also illustrated in FIG. 4B is the insertion of document 402 between document feed roller 113 and document pressure roller 301. This shows the paper path for the printing of form documents, and the illustrates the displacement of Tee bushing 106 into T-notch 112 by the thickness of document 402. It would be understood that this displacement, as depicted in FIG. 4B, is greatly exaggerated. Moreover, it would be understood that in normal operation, document 402 would be in position between document feed roller 113 and document pressure roller 301 for printing when cover-platen opening mechanism 100 is in the closed position, not in the open position illustrated in FIG. 4B. For the purpose of clarity, document 402 has been shown in FIG. 4B, positioned between document feed roller 113 and document pressure roller 301, as for printing.

Figure 4C:
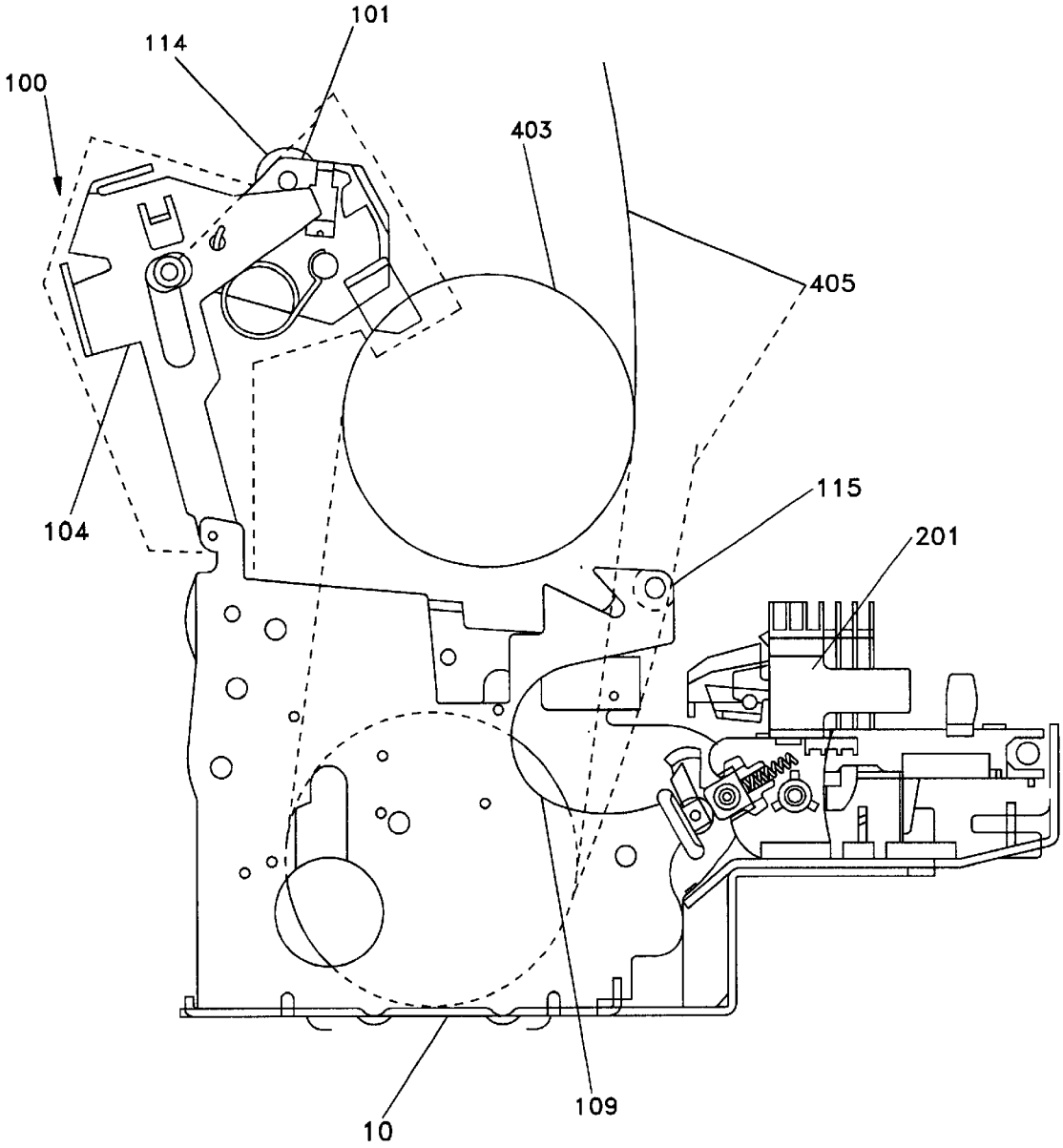
FIG. 4C illustrates, in side view, in fully open position, a cover-platen opening mechanism in accordance with an embodiment of the present invention.
Figure 5:
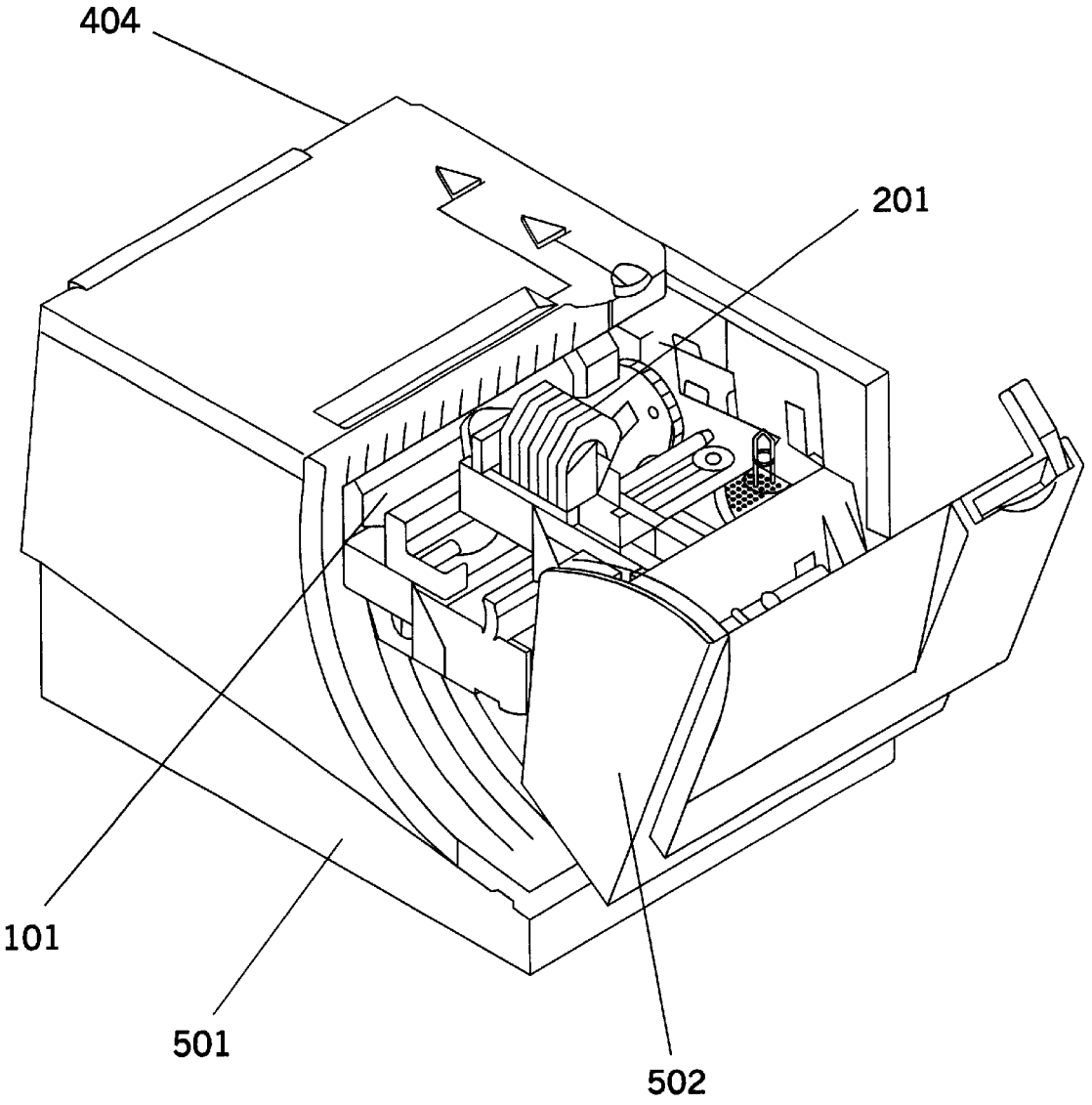
FIG. 5 illustrates, in perspective view, a printer according to an embodiment of the present invention.

The operator continues to apply an opening force to cover frame 104 until cover-platen opening mechanism 100 is in the fully open position, illustrated in FIG. 4C. When cover-platen opening mechanism 100 is in the fully open position, the operator can insert a new roll of paper 403 into printer 404. Loose end 405 then passes through paper gap 202 (not illustrated in FIG. 4C) formed between platen 101 and printhead 201 when cover-platen opening mechanism 100 is closed, as in FIG. 4A. After insertion of new paper roll 403, cover-platen opening mechanism 100 may be closed, and printer 404 is then ready for printing.

In FIG. 1, paper roll drive roller 114 and paper roll back-up roller 115 (partially obscured) are shown. A paper roll drive roller 114 in the "x" direction when it is desired to print on a paper roll. Drive means and paper roll paper are not shown for the sake of clarity. Paper roll drive roller 114 is rotatably supported by frame 108 and paper roll back-up roll 115 is rotatably and compliantly supported by platen 101. Forces between paper roll drive roller 114 and paper roll back-up roll 115 are small as compared to the previously described reaction loads. FIG. 4C shows that loose end 405 is positioned between platen 101 and print head 201 as well as between paper roll drive roller 114 and paper roll back-up roller 115 when cover-platen mechanism 100 moves to the closed position.

As cover-platen opening mechanism 100 moves from the closed position shown in FIG. 4A, through the partially open position in FIG. 4B, to the fully open position in FIG. 4C, torsion spring 103 first compresses and then expands. This is a consequence of the distance between the point of contact with protrusion 111 and the point of attachment of spring end 110 first decreasing, and then increasing as cover fine 104 and platen 101 move through succeeding positions. Platen 101, in combination with torsion spring 103 and cover frame 104, has two stable positions of equilibrium, one where cover-platen opening mechanism 100 is closed, and the other where cover-platen opening mechanism 100 is fully open.

Although the present invention and its advantages have been described in detail, it should be understood that various changes, substitutions and alterations can be made herein without departing from the spirit and scope of the invention as defined by the appended claims.

What is claimed is:

1. A method of refreshing a print medium supply in a printer comprising the steps of:

opening a cover-platen mechanism having a platen to expose a space for receiving said print medium supply;

installing said print medium supply in said space;

returning said cover-platen mechanism to a closed position wherein said platen and a printhead form a gap therebetween for the passage of a leader of said print medium for printing thereon; and wherein when said cover-platen opening mechanism is returned to said closed position, said leader is automatically positioned in said gap between said platen and said printhead without requiring manual threading of said leader.

2. The method of claim 1, wherein said platen rotates from a first position to a second position in response to said opening of said opening mechanism, said rotation permitting said platen to clear said printhead.

3. A method of refreshing a print medium supply in a printer comprising the steps of:

opening a cover-platen mechanism having a platen to expose a space for receiving said print medium supply, said platen rotating from a first position to a second position in response to said opening of said opening mechanism, said rotation permitting said platen to clear a printhead;

installing said print medium supply in said space;

returning said cover-platen mechanism to a closed position wherein said platen and said printhead form a gap therebetween for the passage of a leader of said print medium for printing thereon; and wherein when said cover-platen opening mechanism is returned to said closed position, said leader is automatically positioned in said gap between said platen and said printhead without requiring manual threading of said leader.

* * * * *